US005253903A

United States Patent [19]

Daley

[11] Patent Number: 5,253,903

[45] Date of Patent: Oct. 19, 1993

[54] ESPAGNOLETTE MECHANISM

[75] Inventor: Ernest C. Daley, Nr. Malmesbury, United Kingdom

[73] Assignee: Regent Lock Company Limited, Chippenham, England

[21] Appl. No.: 937,355

[22] Filed: Aug. 27, 1992

[51] Int. Cl.[5] ..... E05C 1/06

[52] U.S. Cl. ..... 292/39; 292/142; 292/336.3

[58] Field of Search ..... 292/336.3, 39, 142

[56] References Cited

U.S. PATENT DOCUMENTS

| | | | |
|---|---|---|---|
| 338,505 | 3/1886 | Flint | 292/39 X |
| 2,166,535 | 7/1939 | Sarenholm et al. | 292/39 X |
| 2,743,126 | 4/1956 | Carsley et al. | 292/39 |
| 3,792,885 | 2/1974 | Giardina et al. | 292/39 |
| 4,476,700 | 10/1984 | King | 292/39 X |
| 4,616,864 | 10/1986 | Douglas | 292/336.3 |
| 4,921,285 | 5/1990 | Loos | 292/39 |
| 5,039,143 | 8/1991 | Ramsauer | 292/39 |

FOREIGN PATENT DOCUMENTS

| | | | |
|---|---|---|---|
| 567696 | 5/1958 | Belgium | 292/39 |
| 0229582 | 7/1987 | European Pat. Off. . | |
| 0338621 | 10/1989 | European Pat. Off. . | |
| 0341329 | 11/1989 | European Pat. Off. . | |
| 0369736 | 5/1990 | European Pat. Off. . | |
| 254615 | 12/1912 | Fed. Rep. of Germany | 292/39 |
| 646285 | 11/1937 | Fed. Rep. of Germany | 292/39 |
| 90012798 | 7/1991 | Fed. Rep. of Germany . | |
| 391769 | of 0000 | France | 292/39 |
| 840050 | 1/1939 | France | 292/39 |
| 270778 | 12/1950 | Switzerland | 292/39 |
| 536578 | 9/1940 | United Kingdom . | |
| 2082665A | 3/1982 | United Kingdom . | |
| 2148377A | 5/1985 | United Kingdom . | |

*Primary Examiner*—Rodney M. Lindsey
*Attorney, Agent, or Firm*—Ronald M. Goldman

[57] ABSTRACT

The invention relates to an espagnolette mechanism comprising a first slidable elongate member or rod and a second slidable elongate member or rod which may be displaced in opposite directions by a drive means which comprises a three tooth quadrant gear member afficable to a rotatable handle (not shown) driven through a square, a second rotatable full bear member which has six teeth and is substantially perpendicular to the quadrant gear, a first rack means connected to the first rod and meshing operatively connected with the first and second rotatable gear members, a second rack means connected to the second rod and meshing with the second rotatable gear member, the arrangement being such that in use turning the handle moves the first rack means longitudinally causing rotation of the second gear member which in turn moves the second rack means and the second rod longitudinally in the opposite direction.

11 Claims, 2 Drawing Sheets

ESPAGNOLETTE MECHANISM

This invention relates to an espagnolette mechanism, or bolt for casement doors and windows.

An espagnolette mechanism, or bolt, usually consists, in a casement window, of a rod lying along the edge of the opening sash of the window away from the hinges thereof and movable longitudinally by an appropriate mechanism, the rod having at its ends or otherwise spaced along it, projections which are engageable with complementary recesses such as keepers in the window frame to hold the window shut. The rod may be split at the middle where each half joins the handle thereby providing two rods which may be driven home at the sill and window head simultaneously, by turning the handle. Such a construction, however, is expensive to manufacture and install.

It is accordingly an object of the invention to seek to provide an espagnolette bolt having a drive mechanism which provides for ease of manufacture and installation.

According to the invention there is provided an espagnolette mechanism, comprising first and second slidable elongate members displaceable in substantially opposite directions and drive means for the elongate members, the drive means comprising a first rotatable gear member adapted to be secured to a rotatable means, a second rotatable gear member, a first rack means connected to the first elongate member and operatively connected with the first and second gear members, and a second rack means connected with the second elongate member and meshing with the second gear member, the arrangement being such that rotation of the first gear member moves the first rack means longitudinally causing rotation of the second gear member which moves the second rack means and the second elongate member longitudinally in the opposite direction.

The first rack means may be operatively connected with the first gear member by an extension of the first elongate member which extension has a further rack means engaged by the first gear member, and may be operatively connected with the second gear member by meshing directly therewith. This provides an efficient construction.

The first and second rack means may be respectively carried by an angle member. This provides a relatively simple construction for providing a rack means, particularly as the angle members may each have a series of through holes in one limb which may comprise the respective first and second rack means. The holes may readily be formed in a forming operation such as punching.

The second angle member may comprise guide means, which may comprise an elongate slot in a limb of the second angle member in which is mounted a journal for the second gear member.

The slot may be a blind slot, so providing positive end positions of the journal.

The first and second gear members may be rotatable about axes disposed substantially mutually perpendicularly. This permits mounting of the gear members adjacent each other, without meshing in a confined space.

The first gear member may be a quadrant gear, suitably having three teeth equiangularly spaced over 90°. This provides a relatively inexpensive but operative gear.

The second gear member may comprise a circular gear, suitably having six teeth. Again, this provides a relatively inexpensive but operative gear.

The elongate members may each have a projection intermediate their distal ends and the gear member for engagement with complementary keeps of, in use, a frame. This provides a positive locking action, in use.

The projection may suitably comprise a roller mounted on a stud.

According to a further aspect the invention provides a closure, having mounted thereon a mechanism as hereinbefore defined.

Espagnolette mechanisms embodying the invention are hereinafter described, by way of example, with reference to the accompanying drawings.

Figure 1:
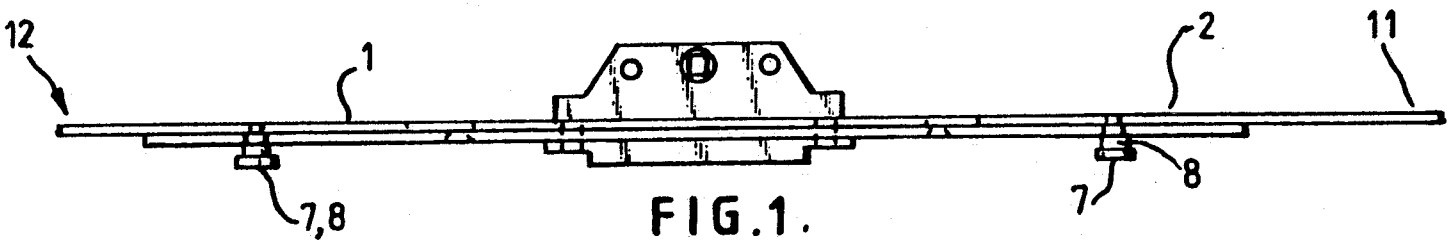
FIG. 1 shows a front elevational view a first embodiment of mechanism according to the invention.
Figure 2:
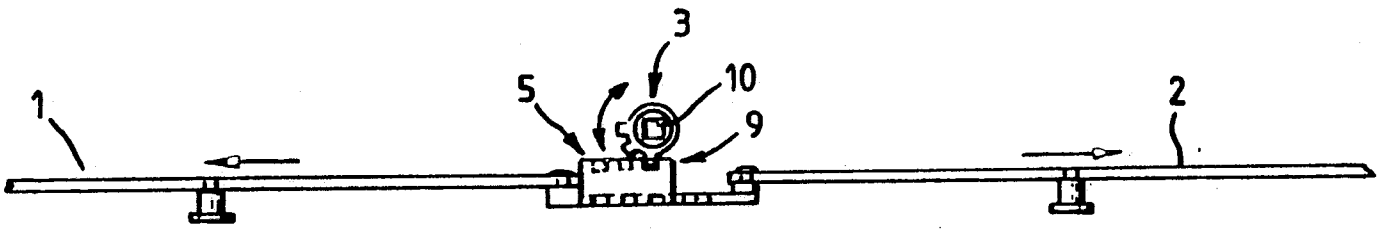
FIG. 2 shows a front elevational view in cross section of the espagnolette mechanism of FIG. 1, with a body removed for clarity.
Figure 3:
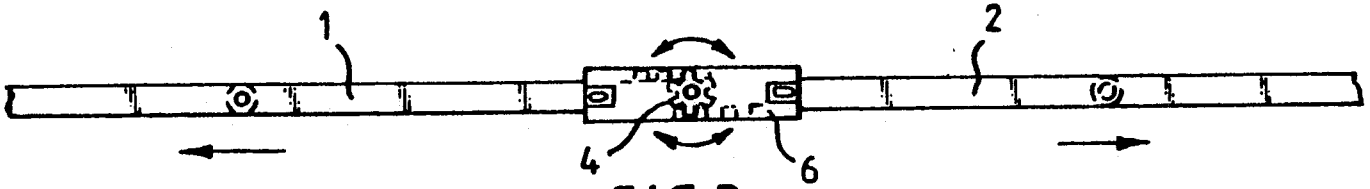
FIG. 3 shows a plan view in cross section of the espagnolette mechanism of FIG. 2.

Referring firstly to FIGS. 1 to 3 of the drawings, there is shown an espagnolette mechanism comprising a first slidable elongate member or rod 1 and a second slidable elongate member or rod 2 which may be displaced in opposite directions by a drive means 9 which comprises a three tooth quadrant gear member 3 affixable to a rotatable handle (not shown) driven through a square 10, a second rotatable full gear member 4 which has six teeth and is substantially perpendicular to the quadrant gear 3, a first rack means 5 connected to the first rod 1 and meshing operatively connected with the first and second rotatable gear members 3 and 4, a second rack means 6 connected to the second rod 2 and meshing with the second rotatable gear member 4, the arrangement being such that in use turning the handle moves the first rack means 5 longitudinally causing rotation of the second gear member 4 which in turn moves the second rack means 6 and the second rod 2 longitudinally in the opposite direction as shown by the arrows in FIGS. 1-3.

Each rod 1, 2 is provided with a stud and roller device 7, 8 which is mounted on it between the drive mechanisms 9 and its distal ends 11 and 12. The projections 7 and 8 are engageable with complementary keepers in the frames of doors and windows when the rods 1 and 2 are in their closed positions. The rollers may be attached to the rods by rivets so that each roller can turn on its axis relative to the rods.

Figure 4:
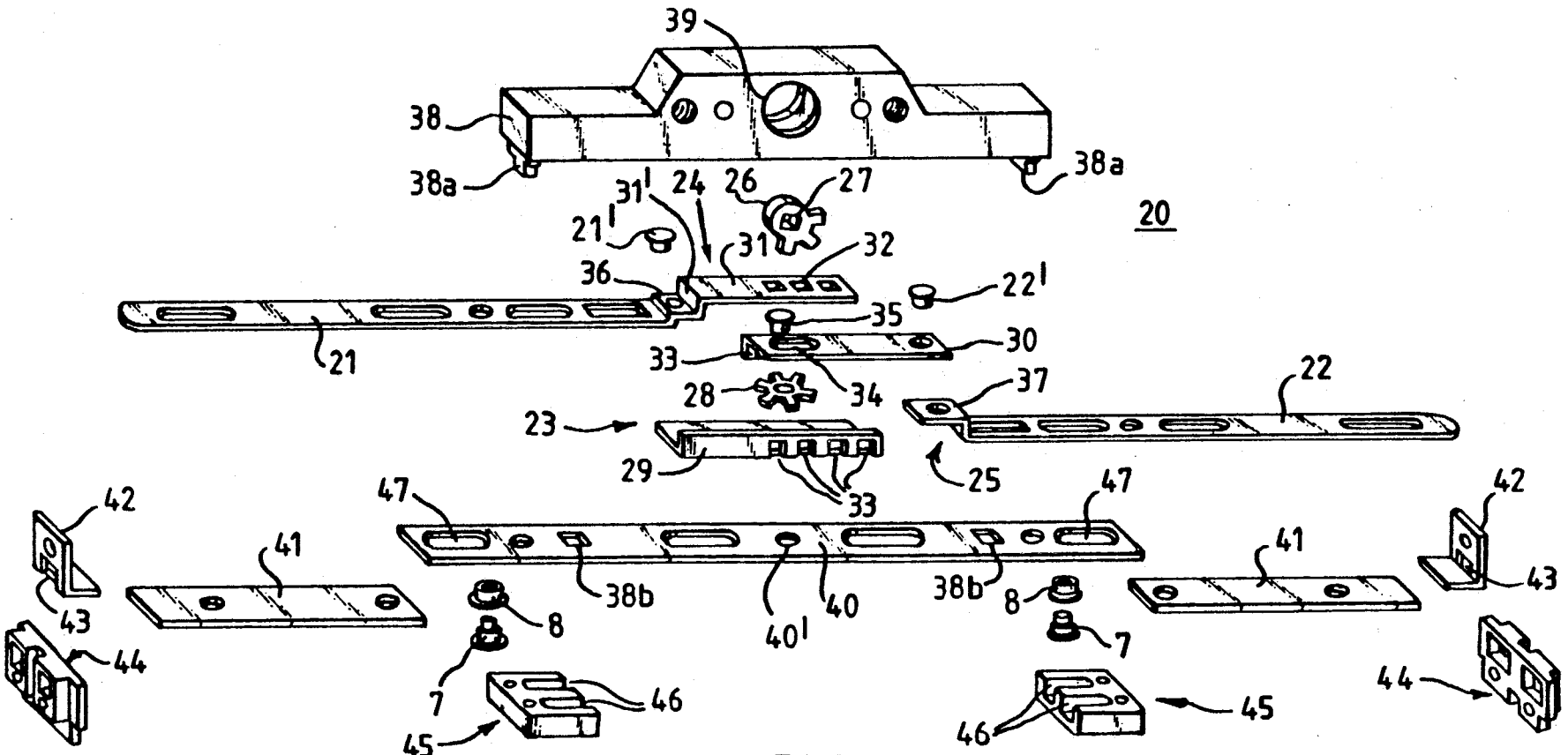
FIG. 4 is an exploded perspective view of a second embodiment of espagnolette mechanism according to the invention.

Referring to FIG. 4 of the drawings, in which parts like parts in FIGS. 1 to 3 are referred to by identical reference numerals, there is shown an espagnolette mechanism 20 comprising first and second slidable elongate members 21 and 22 displaceable in substantially opposite directions and drive means 23 for the elongate members, which elongate members 21, 22 comprise flat shoot bolts, the first one being longer than the second one and both having a stepped proximal end 24, 25, adjacent the drive means 23. The drive means 23 comprises a first rotatable gear member 26 adapted to be secured to rotatable means such as a rotatable handle (not shown) having a square section shaft for insertion in a square hole 27 of the gear member. The handle may be temporarily fixed to the gear by the shaft being a push fit in the hole for operation of the drive means. The drive means 23 also comprises a second rotatable gear member 28, a first rack means 29 connected to the first elongate member 21 and operatively connected with the first and second gear members 26, 28 and a second rack means 30 connected with the second elongate member 22 and meshing with the second gear member 28.

The first rack means 29 is operatively connected with the first gear member by an extension 31 of the first elongate member 21 at the proximal end thereof, the extension 31 having a further rack means 32 engaged by the first gear member 26. The first rack means 29 is operatively connected with the second gear member 28 by meshing directly therewith. To provide meshing with the rack means, the first gear member 26 is of quadrant shape and has three equiangularly spaced teeth in the embodiment, and the second gear member 28 is circular in plan with six equiangularly spaced peripheral teeth.

Each rack means 29, 30 comprises an angle section member of substantially L-shape, one limb of each member having spaced through holes 33 which provide the rack means. One L-shape 29 is inverted with respect to the other 30 and reversed so that the perforated limbs are vertically disposed (as viewed) and lie substantially in parallel, the other limbs then lying substantially horizontally and substantially in parallel.

The horizontal (as viewed) limb of the second rack means 30 has a blind slot 34 through which passes a central pin 35 which mounts the gear member 28 for rotation. The pin head is received below the first elongate member 21 a step 31 being to accommodate the head, the first member 21 then being able to slide over the head. The rivet 35 passes through the first rack means and is received in a hole 40' in a cover plate 40.

The first rack means 29 is secured to the first elongate member 21 by securing means such as a rivet 21' which passes through a second step 36 at the proximal end of the first elongate member 21. Likewise the second elongate member 22 and rack 30 are secured by securing means such as a rivet passing through a stepped proximal end 37 of the second elongate member 22.

The mechanism 22 is supported from a housing 38 which has a hole 39 for access to the square hole 27 in the first gear member 26 and which when the mechanism is assembled is exposed through the hole 39.

The housing 38 is secured to the mechanism by mounts 38*a* secured to the cover 40 by rivets in holes 38*b* of the cover 40. There are end covers 41 there being end cover guides 42 with slots 43 through which the distal ends of the respective elongate members 21, 22 or shoot bolts pass for engagement with or release from keep ends 44, in use, a frame of a closure mounting the espagnolette mechanism 20, the frame also mounting intermediate keeps 45 with blind slots 46 for receiving studs and rollers 8, 7 as in the first embodiment. The studs 7, 8 pass through respective elongate holes 47 in the cover 40 to be secured as by screwing into a hole in the respective elongate member or shoot bolt.

The keep ends 44 and keeps 46 are handed for mounting with any hang of closure, having two slots 44', 46 respectively for receiving the distal ends of the bolts, and rollers 7, 8.

In use, a handle turns the first gear member 26 clockwise, as viewed, so that the gear engages the teeth with the further rack 32, so shooting the bolt 21 to the left as viewed. Simultaneously, the first means 29 is moved to the left too, being secured with the shoot bolt by the rivet. This in turn rotates the second gear member 28, also in a clockwise sense so that it as it meshed with the second rack means 30, with the pivot at the centre of the slot 34, moves that rack means 30 to the right as viewed, which in turn throws the second shoot bolt 22 to the right, both the distal ends of the bolts 21, 22 engaging the end keeps 44 and the studs and rollers 7, 8 engaging in the keeps 45. A closure mounting the mechanism is then securely closed. A reverse turning of the gear member 26 has an opposite effect so that the two elongate members are moved longitudinally in opposite directions towards one another to release the distal ends and studs and rollers so that the closure can be opened.

The mechanism described is positive in operation and relatively simple to install in a relatively small space as the mutually perpendicular arrangement of the gears 26, 28 ensures that the mechanism can be mounted in a small space. The mechanism provides a smooth aspect as all the operating parts are above (as viewed in FIG. 4) the cover plate 40.

It will be understood that the mechanism of FIG. 4 for example may be modified. For example, there may be two gear wheels 28 spaced apart longitudinally of the rack means 29, 30. Such a mechanism operates identically to the mechanism of FIG. 4, the two gear wheels providing a positive action which obviates any tendency to lash.

I claim:

1. An espagnolette mechanism, comprising, (i) a first elongate member, (ii) a second elongate member, (iii) said first and second elongated members being slidably displaceable in substantially opposite directions, (iv) drive means for said elongate members, (v) the drive means comprising, (vi) a first rotatable gear member adapted to be connected with a rotatable means, (vii) a second rotatable gear member, (viii) a first rack means connected to the first elongate member and operatively connected with the first and second gear members, (ix) a second rack means connected with the second elongate member, (x) the first and second rack means being respectively defined by an L-section angle member, (xi) the L-section angle members being assembled together to form a substantially rectangular housing in which said second rotatable gear member is mounted, opposite walls of said housing defined by opposite substantially parallel limbs of the angle section members defining the respective first and second rack means, (xii) wherein rotation of the first gear member moves the first rack means longitudinally causing rotation of the second gear member which moves the second rack means and the second elongate member longitudinally in the opposite direction.

2. A mechanism as defined in claim 1, wherein said first rack means is operatively connected with said first gear member by an extension of said first elongate member which extension includes a further rack means engaged by said first gear member, and wherein said first rack means is operatively connected with the second gear member by meshing directly therewith.

3. A mechanism as defined in claim 1, wherein said angle member of said second rack means comprises guide means having an elongate slot in a limb of the second angle member and a journal for the second gear member mounted in said elongate slot.

4. A mechanism as defined in claim 1, wherein said first gear member is a quadrant gear.

5. A mechanism as defined in claim 1, wherein said first gear member is a quadrant gear and wherein said second gear member is a circular gear.

6. A mechanism as defined in claim 1, wherein said elongate members each include a projection intermediate their distal ends and the gear members for engagement with complementary keeps of, in use, a frame.

7. A mechanism as defined in claim 1, wherein said second rotatable gear member comprises first and second gears in spaced relationship.

8. An espagnolette mechanism, comprising: a first elongate bolt member; a second elongate bolt member; said first and second elongate bolt members being mounted for sliding displacement in substantially opposite directions;

drive means for said elongate bolt members, said drive means comprising:

a first rotatable gear means, said first rotatable gear means having an axis of rotation oriented in a first direction; and means for manually pivoting said first gear means about said axis;

a second rotatable gear means, said second gear means having an axis of rotation oriented in a second direction perpendicular to said first direction;

a first rack means, said first rack means being connected to said first elongate bolt member and being operatively connected in driven relationship with said first gear means and being operatively connected in driving relationship with said second gear means;

a second rack means connected with said second elongate bolt member and being connected in driven relationship with said second gear means;

said first and second rack means each being respectively defined by respective first and second L-section angle members, with said L-section angle members being assembled together in inverted relationship to form a substantially rectangular housing with opposite walls of said housing defined by opposite substantially parallel limbs of said angel section members and with a pair of opposed parallel limbs of said angle section members further defining said respective first and second rack means; said second rotatable gear means being supported for rotation within said formed housing in engagement with each of said first and second rack means, whereby rotation of said first gear means slidably displaces said first rack means longitudinally causing rotation of said second gear means, which, in turn, slidably displaces said second rack means and said second elongate bolt member longitudinally in a direction opposite to the direction of movement of said first rack means.

9. The invention as defined in claim 8 wherein said driven relationship between said first gear means and said first rack means, further comprises:

third rack means; said third rack means being mounted in overlying relationship of said first rack means and being mechanically coupled to said first rack means for joint movement therewith; and said first gear means being mounted in operative driving engagement with said third rack means, whereby rotation of said first gear means concurrently moves said third and first rack means.

10. The invention as defined in claim 9 wherein said third rack means is connected to an end of said first elongate bolt member proximate said connection between said first elongate bolt member and said first rack means; and wherein each of said first, second and third rack means each comprise a series of spaced holes for receiving the teeth of a gear means; and wherein said first gear means comprises a quandrant gear; and wherein said second L-shaped angle member includes an elongate slot opening into said formed housing; and further comprising pin means extending through said elongate slot opening into said formed housing for axially supporting said second gear means for rotational movement with the teeth of said second gear means being in meshing engagement with said first and second rack means.

11. A compact espagnolette mechanism, comprising: a first elongate bolt member; a second elongate bolt member; said first and second elongate members being slidably displaceable in substantially opposite directions;

drive means for said elongate members, said drive means comprising:

first driving means;

rotational gear means, said gear means having an axis of rotation;

a first rack means, said first rack means being connected to said first elongate bolt member and being operatively connected in driven relationship with said first driving means and in driving relationship with said gear means;

a second rack means connected with said second elongate bolt member and being connected in driven relationship with said gear means;

said first and second rack means each being respectively defined by an elongate L-section angle member, with said L-section angle members being assembled together in inverted relationship to form a substantially rectangular housing with opposite walls of said housing defined by opposite substantially parallel limbs of said angel section members and further defining said respective first and second rack means; and wherein said gear means is supported for rotation within said formed housing, whereby movement of said driving means moves said first rack means longitudinally in a first direction causing rotation of said gear means which in turn moves said second rack means and said second elongate bolt member longitudinally in a direction opposite to the direction of movement of said first rack means.

* * * * *